US011459134B2

(12) United States Patent
Sauter

(10) Patent No.: US 11,459,134 B2
(45) Date of Patent: Oct. 4, 2022

(54) THERMOFORMING PACKAGING MACHINE WITH SPACE-SAVING FILM SOURCE

(71) Applicant: MULTIVAC SEPP HAGGENMUELLER SE & CO. KG, Wolfertschwenden (DE)

(72) Inventor: Sebastian Sauter, Breitenbrunn (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 17/218,679

(22) Filed: Mar. 31, 2021

(65) Prior Publication Data

US 2021/0300605 A1 Sep. 30, 2021

(30) Foreign Application Priority Data

Mar. 31, 2020 (DE) ..... 102020204142 .3

(51) Int. Cl.
*B65B 9/04* (2006.01)
*B65B 47/04* (2006.01)
(Continued)

(52) U.S. Cl.
CPC ..... *B65B 9/04* (2013.01); *B65B 41/12* (2013.01); *B65B 41/16* (2013.01); *B65B 47/02* (2013.01); *B65B 47/04* (2013.01); *B65B 65/003* (2013.01)

(58) Field of Classification Search
CPC ..... B65B 9/04; B65B 41/12; B65B 41/16; B65B 47/02; B65B 47/04; B65B 65/003
(Continued)

(56) References Cited

U.S. PATENT DOCUMENTS 3,003,542 A * 10/1961 Butler, Jr. ..... B65B 41/12 156/350
3,440,126 A 4/1969 Bartholomay et al.
3,673,760 A 7/1972 Canamero et al.
4,936,076 A * 6/1990 Hautemont ..... B65C 9/1803 53/64
(Continued)

FOREIGN PATENT DOCUMENTS

DE 1 574 335 A1 6/1971
DE 28 05 076 A1 8/1979
(Continued)

OTHER PUBLICATIONS

German Search Report dated Aug. 28, 2020, Applicant No. 10 2020 204 142.3, Applicant MULTIVAC Sepp Haggenmueller SE & Co. KG, 9 Pages.
(Continued)

*Primary Examiner* — Stephen F. Gerrity
(74) *Attorney, Agent, or Firm* — Brooks Kushman P.C.

(57) ABSTRACT

A thermoforming packaging machine comprises a film source, a forming station, a sealing station and a conveying device. The film source is configured to receive a lower film supply roll and provide a lower film web unwound from the lower film supply roll. The conveying device is configured to convey the lower film web from the film source to the forming station and further to the sealing station. The film source comprises a holding mandrel for receiving thereon the lower film supply roll and a film storage device configured for accommodating a variable length of the lower film web and regulating a film tension of the lower film web. The holding mandrel and the film storage device are arranged one above the other in a vertical direction.

20 Claims, 2 Drawing Sheets

(51) Int. Cl.

| | |
|---|---|
| ***B65B 65/00*** | (2006.01) |
| ***B65B 41/16*** | (2006.01) |
| ***B65B 41/12*** | (2006.01) |
| ***B65B 47/02*** | (2006.01) |

(58) Field of Classification Search
USPC ..... 53/453, 559, 384.4
See application file for complete search history.

(56) References Cited

U.S. PATENT DOCUMENTS

| | | | | |
|---|---|---|---|---|
| 5,201,163 | A | 4/1993 | Reil et al. | |
| 2010/0287882 | A1* | 11/2010 | Alberti et al. | B65B 41/16 53/220 |
| 2012/0100978 | A1 | 4/2012 | Tommasi | |
| 2012/0292422 | A1 | 11/2012 | Bonneville et al. | |
| 2016/0221270 | A1* | 8/2016 | Yu | B65B 47/04 |
| 2018/0334271 | A1* | 11/2018 | Wolf et al. | B65B 41/16 |
| 2019/0283913 | A1 | 9/2019 | Ehrmann | |

FOREIGN PATENT DOCUMENTS

| | | | | |
|---|---|---|---|---|
| DE | 697 07 920 | T2 | 3/2003 | |
| DE | 202017102548 | U1 * | 7/2017 | B65B 41/16 |
| DE | 10 2018 204 044 | A1 | 9/2019 | |
| EP | 0 428 897 | A2 | 5/1991 | |
| EP | 1 167 193 | A2 | 1/2002 | |
| EP | 2 514 697 | A2 | 10/2012 | |
| EP | 2942295 | A1 * | 11/2015 | B65B 41/16 |
| WO | 2004/074106 | A1 | 9/2004 | |
| WO | WO-2016066617 | A1 * | 5/2016 | B65B 41/12 |
| WO | WO-2016087169 | A1 * | 6/2016 | B65B 41/16 |
| WO | 2020/058278 | A2 | 3/2020 | |

OTHER PUBLICATIONS

European Search Report dated Aug. 30, 2021 (with English Machine Translation), Application No. 21163856.4-1016, Applicant MULTIVAC Sepp Haggenmueller SE & Co. KG, 8 Pages.

* cited by examiner

THERMOFORMING PACKAGING MACHINE WITH SPACE-SAVING FILM SOURCE

CROSS-REFERENCE TO RELATED APPLICATIONS

This application claims foreign priority benefits under 35 U.S.C. § 119(a)-(d) to German patent application number DE 10 2020 204 142.3, filed Mar. 31, 2020, which is incorporated by reference in its entirety.

TECHNICAL FIELD

The present disclosure relates to a thermoforming packaging machine.

BACKGROUND

In known thermoforming packaging machines, a lower film web is conveyed along a production direction and passes successively through a forming station, an infeed path, a sealing station and a cutting station. In the forming station, packaging troughs are formed in the lower film web by thermoforming. Along the infeed path, products to be packed are placed in the packaging troughs. In the sealing station, the packaging troughs are closed by sealing a top film thereto. In the cutting station, the sealed packages are separated from the film web.

The lower film web to be processed is unwound from a lower film supply roll. A film holder for receiving the lower film supply roll may be arranged linearly upstream of the forming station with respect to the production direction. Alternatively, a thermoforming packaging machine is known from DE 10 2018 204 044 A1, in which the film holder is arranged such that it is offset by 90° with respect to the production direction, so as to save installation space along the production direction.

To ensure that the film tension of the lower film web is kept within a suitable range during operation of the thermoforming packaging machine, it is known to provide a film storage device between the film holder and the forming station. Due to the film storage device, a certain minimum distance is required between the film holder and the forming station. Depending on the orientation of the film holder, provision of the film storage device leads to an increase in length of the thermoforming packaging machine in the production direction or an increase in the space required by the thermoforming packaging machine in the lateral direction.

EP 2 514 697 A2 discloses a system for supplying a packaging machine with a web of material. The system comprises a motor for rotating a roll of material and a dancer provided downstream of the roll of material, the dancer being movable between a first position and a second position depending on a tension of the web.

EP 1 167 193 A1 discloses a bag packaging machine, in which a freely rotating film roll, a film storage device for compensating the conveyed film web lengths, a driven film feed roller pair for controlled conveyance of precise film sections, a format part consisting of a format shoulder and a format tube, and a film pull-off belt pair follow one after the other along the conveying direction of a film. The format part converts the flat film into a tubular film around the tube. A product to be filled is filled into the tubular film through a funnel and the bag is sealed. In a schematic representation, the film storage device is shown above the freely rotating film roll in the conveying direction of the film. The fact that the film web is first guided upwards from the film roll is a consequence of the overall geometry of the bag packaging machine. Due to the different operating principles and the established design practice for different packaging machines, the special way of arranging the components of the bag packaging machine would not have been transferred to a thermoforming packaging machine without knowledge of the present disclosure.

SUMMARY

It is an object of the present disclosure to provide a thermoforming packaging machine that requires less space.

A thermoforming packaging machine according to the disclosure comprises a film source, a forming station, a sealing station and a conveying device. The film source is configured to accommodate a lower film supply roll and provide a lower film web unwound from the lower film supply roll. The forming station is configured to form packaging troughs in the lower film web by means of thermoforming. The sealing station is configured to close the packaging troughs by sealing an upper film to the lower film web. The conveying device is configured for conveying the lower film web from the film source to the forming station and further to the sealing station. The film source comprises a holding mandrel for receiving the lower film supply roll. In addition, the film source comprises a film storage device. The film storage device is configured to accommodate a variable length of the lower film web and to regulate a film tension of the lower film web. The holding mandrel and the film storage device are arranged one above the other in a vertical direction.

As the holding mandrel for the lower film supply roll and the film storage device are arranged one above the other in a vertical direction, a more compact structural design of the thermoforming packaging machine can be accomplished in comparison with a packaging machine in which the film storage device is arranged between the holding mandrel and the forming station. In particular, a distance between the holding mandrel and the forming station may be reduced. The film storage device may make use of hitherto unused installation space.

The film source may comprise a frame having attached thereto the holding mandrel and the film storage device. With a frame that is common to the holding mandrel and the film storage device, the film source may be provided with a particularly compact structural design and may be transported as a unit. The frame may be configured as a separate frame or may be part of a machine frame of the thermoforming packaging machine. The machine frame of the thermoforming packaging machine may support the forming station and the sealing station.

The film storage device may comprise a dancer. By means of a dancer, the film tension of the lower film web may be regulated in a way that is easy to implement. The dancer may be preloaded with a predefined force, which preferably corresponds to a desired film tension. Preloading the dancer may be accomplished by a preloading element, such as a preload spring. However, the dancer may, for example, also be preloaded by its own weight.

The film storage device may comprise deflection elements for deflecting the lower film web. Preferably, the deflection elements comprise at least one stationary deflection element and at least one movable deflection element. In particular, the at least one stationary deflection element may be fixedly connected to a frame of the film source or a machine frame of the thermoforming packaging machine. In particular, the at least one movable deflection element may be movable with respect to a frame of the film source or with respect to a machine frame of the thermoforming packaging machine. By means of a movement of the at least one movable deflection element, the length of the lower film web portion accommodated in the film storage device may be varied.

The lower film web may enter the film storage device on a first side of the holding mandrel and exit the film storage device on a second side of the holding mandrel, opposite the first side. The lower film web may pass above the holding mandrel or below the holding mandrel within the film storage device. If the lower film web is guided within the film storage device from one side of the holding mandrel to the other side of the holding mandrel, the installation space available above the holding mandrel or below the holding mandrel will be utilized in a particularly efficient manner.

The lower film web may enter the film storage device in a substantially horizontal direction. The lower film web may exit the film storage device along a substantially horizontal direction. When passing through the film storage device, the lower film web may travel a distance in a direction that is perpendicular to the longitudinal direction of the holding mandrel. The direction perpendicular to the longitudinal direction of the holding mandrel may, in particular, be a horizontal direction.

The holding mandrel may be configured to allow a rotation of the lower film supply roll attached to the holding mandrel. According to an embodiment, the lower film supply roll may rotate freely on the holding mandrel.

The holding mandrel may be configured to receive the lower film supply roll thereon in a non-rotatable manner. A non-rotational connection between the holding mandrel and the lower film supply roll allows a particularly precise control of the unwinding of the lower film.

The film source may have a drive unit for driving the holding mandrel to unwind the lower film web. In particular in the case of large and heavy lower film supply rolls, it may be useful to actively unwind the lower film supply roll by driving the holding mandrel, so as to keep the load on the film as low as possible.

The drive unit may be configured to drive the holding mandrel for continuously and uniformly unwinding the lower film web. In particular, the drive unit may be configured to drive the holding mandrel such that a speed of rotation of the lower film supply roll is constant.

The forming station and the sealing station may be operated in a clocked mode. The film storage device may regulate the film tension of the lower film web in such a way that the film tension of the lower film web is kept within a predetermined range during operation of the thermoforming packaging machine, even if the forming station and the sealing station are operated in a clocked mode and the lower film web is unwound in a continuous and uniform manner. In particular, the film storage device may accommodate an increased length of the lower film web during a working cycle of the forming station and the sealing station, i.e., when no film advance takes place in the region of the forming station and the sealing station, and then release this increased length during an advance cycle of the forming station and the sealing station, i.e., when the lower film web is advanced in the region of the forming station and the sealing station.

According to an embodiment, the film storage device is arranged above the holding mandrel. A film storage device arranged above the holding mandrel is particularly easily accessible for feeding the lower film web into the film storage device at the start of operation. In addition, the holding mandrel may be arranged comparatively low in this case, which may facilitate equipping the holding mandrel with the lower film supply roll.

Alternatively, the film storage device may be arranged below the holding mandrel. If the film storage device is arranged below the holding mandrel, the holding mandrel is easily accessible from above, which, in certain situations, may be of advantage for replacing the lower film supply roll.

According to an embodiment, the film source, the forming station and the sealing station are arranged linearly one after the other in a product line. This embodiment results in a slim packaging machine with respect to a width direction.

According to another embodiment, the forming station and the sealing station are arranged linearly one after the other in a production line and the film source is arranged laterally offset relative to the production line. In an embodiment of this kind, the packaging machine may be comparatively short.

That certain components of the thermoforming packaging machine are "arranged linearly one after the other in a production line" means that the components are arranged linearly one after the other in a top view of the thermoforming packaging machine. However, it is quite conceivable that the components of the thermoforming packaging machine are arranged on different height levels.

The film source may comprise a gluing table, which is movable between a use position and a stowed position. In the use position, the gluing table may provide a working surface oriented parallel to a path of the lower film web. In the stowed position, the gluing table may be distanced from the path of the lower film web, in comparison with the use position. The working surface provided by the gluing table in the use position may be used to connect, e.g., by means of an adhesive tape, an end of the previous lower film web with a leading end of the lower film web unwound from the new lower film supply roll in a lower film supply roll exchange process. By connecting the two lower film webs, operation of the thermoforming packaging machine may be continued directly after the exchange of the lower film supply roll.

The gluing table may be provided along the path of the lower film web between the holding mandrel and the film storage device. When the film ends are connected to one another on the gluing table upstream of the film storage device, manual feeding of the lower film web into the film storage device will not be necessary.

The gluing table may be movable between the use position and the stowed position by rotation about an axis. The gluing table may easily be pivoted to the use position by rotation about the axis, if required. The axis may be a vertical axis.

BRIEF DESCRIPTION OF THE DRAWINGS

In the following, embodiments according to the present disclosure will be explained in more detail, making reference to the figures.

DETAILED DESCRIPTION

Figure 1:
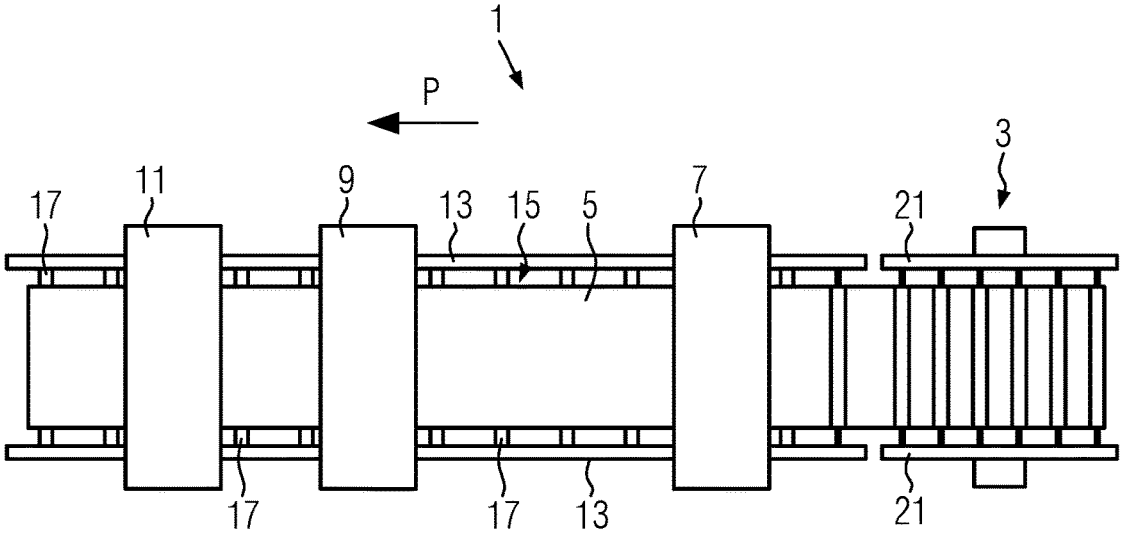
FIG. 1 shows a schematic top view of a thermoforming packaging machine according to an embodiment in which the film source, the forming station and the sealing station are arranged linearly one after the other in a production line.
Figure 2:
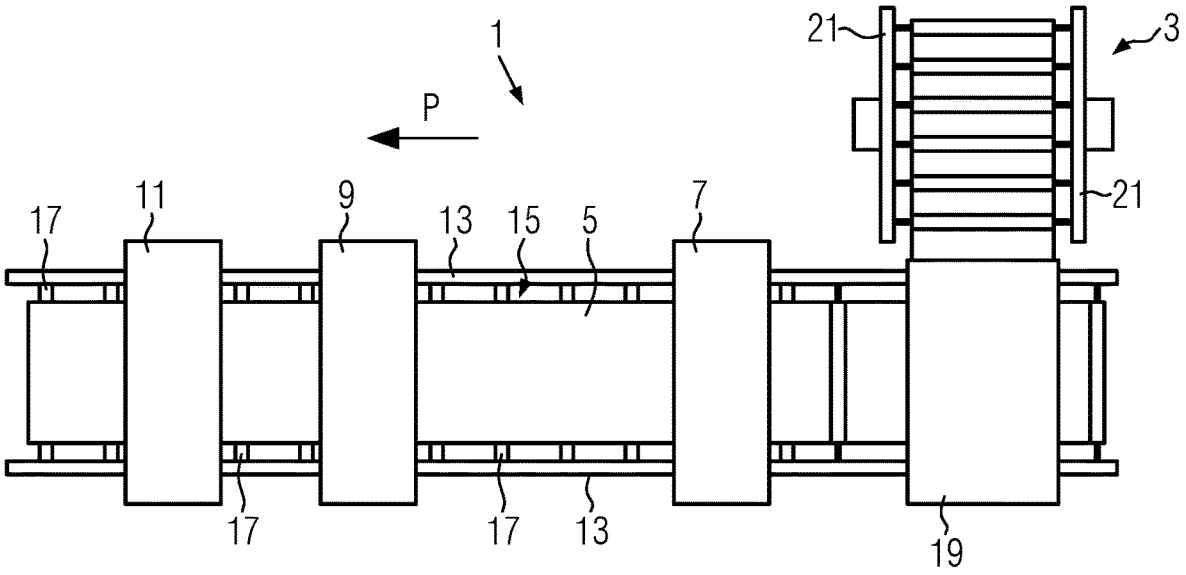
FIG. 2 shows a schematic top view of a thermoforming packaging machine according to another embodiment in which the forming station and the sealing station are arranged linearly one after the other in a production line and the film source is arranged laterally offset relative to the production line.

FIGS. 1 and 2 show different embodiments of a thermoforming packaging machine 1. The thermoforming packaging machine 1 comprises in both embodiments a film source 3 for providing a lower film web 5. The thermoforming packaging machine 1 additionally comprises a forming station 7, a sealing station 9 and a cutting station 11. A machine frame 13 of the thermoforming packaging machine 1 has provided thereon a conveying device 15 conveying the lower film web 5 from the film source 3 to the forming station 7, further to the sealing station 9 and still further to the cutting station 11. For this purpose, the conveying device 15 may, for example, comprise continuously circulating chains on both lateral sides of the lower film web 5, the chains having clamping elements 17 which grip the lower film web 5.

In the forming station 7, packaging troughs are formed into the lower film web 5 by thermoforming. The forming station 7 may comprise a forming tool upper part and a forming tool lower part between which the lower film web 5 is thermoformed. Between the forming station 7 and the sealing station 9, products to be packaged are fed into the packaging troughs. In the sealing station 9, the filled packaging troughs are closed by sealing-on an upper film. For this purpose, the sealing station 9 may comprise a sealing tool upper part and a sealing tool lower part, which seal between them the upper film onto the lower film web. In the cutting station 11, the sealed packages are separated from the film web.

Both in the embodiment according to FIG. 1 and in the embodiment according to FIG. 2, the forming station 7, the sealing station 9 and the cutting station 11 are arranged linearly one after the other in a production line extending along a production direction P. The embodiments according to FIGS. 1 and 2 differ from one another in how the film source 3 is arranged in relation to the production line. In the embodiment shown in FIG. 1, the film source 3 is also arranged in the production line, linearly upstream of the forming station 7, the sealing station 9 and the cutting station 11. In the embodiment according to FIG. 2, however, the film source 3 is arranged laterally offset relative to the production line. This allows the thermoforming packaging machine 1 to be configured with shorter dimensions along the production direction P, or an additional working station can be provided along the production direction P while maintaining a similar length of the thermoforming packaging machine 1. In FIG. 2, such an additional working station is provided in the form of a preheating station 19 for preheating the lower film web 5 before it arrives at the forming station 7. Below the preheating station 19, there is a deflection device, which deflects the lower film web 5 from the direction, in which it exits the film source 3, into the production direction P. Such a deflection device is described e.g., in DE 10 2018 204 044 A1.

Figure 3:
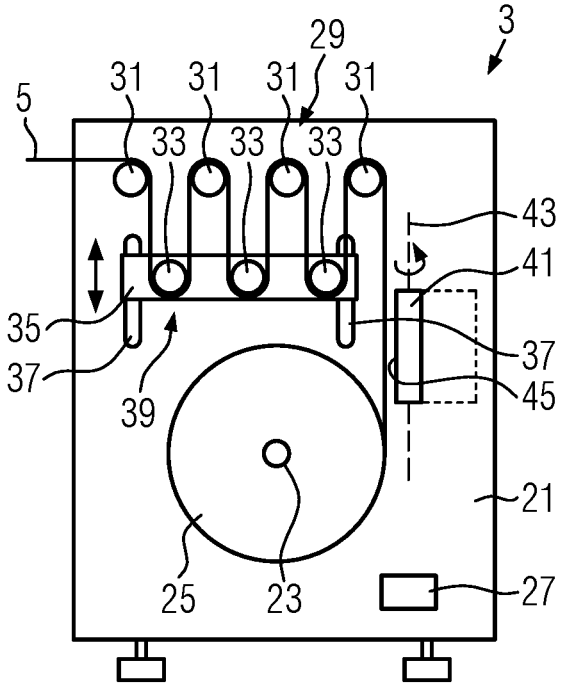
FIG. 3 shows a schematic sectional view of a film source according to an embodiment in which the film storage device is arranged above the holding mandrel.

FIG. 3 shows a sectional view of the film source 3 according to an embodiment. The film source 3 shown in FIG. 3 may be used together with the embodiment according to FIG. 1 or together with the embodiment according to FIG. 2.

The film source 3 comprises a frame 21 configured separately from the machine frame 13. Alternatively, the frame 21 of the film source 3 may be configured as part of the machine frame 13.

The film source 3 comprises a holding mandrel 23 for receiving thereon a lower film supply roll 25. The lower film supply roll 25 could be received on the holding mandrel 23 such that it is rotatable relative to the holding mandrel 23. In this case, the lower film web 5 could be unwound by the forward movement of the conveying device 15. However, in particular in the case of larger lower film supply rolls 25, it will be advantageous if the lower film supply roll 25 is non-rotatably connected to the holding mandrel 23 and the holding mandrel 23 is driven by means of a drive unit 27 for unwinding the lower film web 5.

The film source 3 further comprises a film storage device 29 attached to the frame 21. The film storage device 29 comprises a plurality of stationary deflection elements 31, in particular stationary deflection rollers, and a plurality of movable deflection elements 33, in particular movable deflection rollers. As shown in FIG. 3, the lower film web 5 moves along a path defined by the deflection elements 31, 33. In the illustrated embodiment, the movable deflection elements 33 are movable together. To this end, the movable deflection elements 33 are attached to a support element 35 on both sides of the lower film web 5. The support elements 35 are movable in a guide structure 37 of the frame 21. The movable deflection elements 33 arranged on the support elements 35 form a dancer 39. In the illustrated embodiment, the dancer 39 is preloaded by its weight in the guide structures 37 of the frame 21 to a lower position at which the film storage device 29 accommodates an increased length of the lower film web 5. Alternatively, the dancer 39 could be preloaded by a preloading element, such as a preload spring.

The dancer 39 regulates a film tension of the lower film web 5. If the film tension decreased, the dancer 39 would move downwards, thus compensating for the decreasing film tension. If the film tension increased, the dancer 39 would be pulled upwards, thus releasing an additional length of the lower film web 5, whereby the increased film tension would be compensated for. By continuously and uniformly rotating the holding mandrel 23, the drive unit 27 may, for example, continuously unwind the lower film web 5 at a constant unwinding rate. Variations in the film tension of the lower film web 5 that would occur during continuous unwinding of the lower film web 5, if e.g., the forming station 7, the sealing station 9 and the cutting station 11 were operating in a clocked mode, are compensated for by the film storage device 29.

In the embodiment according to FIG. 3, the film storage device 29 is provided above the holding mandrel 23. The film source 3 may thus be provided with a compact structural design and placed close to the forming station 7.

Figure 4:
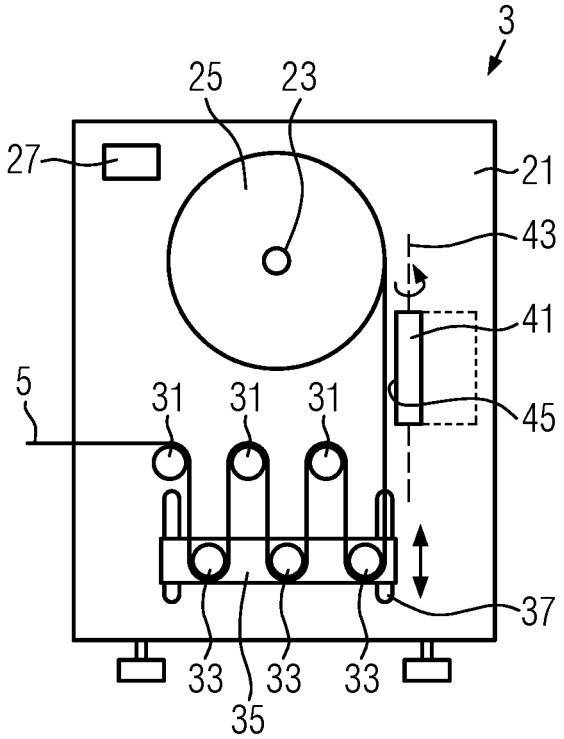
FIG. 4 shows a schematic sectional view of a film source according to another embodiment in which the film storage device is arranged below the holding mandrel.

FIG. 4 shows an alternative embodiment of the film source 3. Also the embodiment of FIG. 4 may be used both in the embodiment according to FIG. 1 and in the embodiment according to FIG. 2. The embodiment according to FIG. 4 differs from the embodiment according to FIG. 3 only insofar as the film storage device 29 is not provided above the holding mandrel 23, but is provided below the holding mandrel 23. Also in this case, the film source 3 may be provided with a compact structural design and placed particularly close to the forming station 7.

In the illustrated embodiments, the film source 3 further comprises a gluing table 41. The gluing table 41 is rotatable about a vertical axis 43 between a use position and a stowed position. In the figures, the use position of the gluing table 41 is shown in solid lines and the stowed position is shown in dashed lines. In the use position, the gluing table provides a working surface 45 oriented parallel to the path of the lower film web 5. The working surface 45 may be used for gluing the leading end of the new lower film web 5 to the trailing end of the previously processed lower film web 5, when the lower film supply roll is exchanged. It will be expedient to carry out the gluing of the film ends before the end of the lower film web 5 arrives at the film storage device 29. In the stowed position shown in dashed lines in the figures, the gluing table 41 has been rotated away from the path of the lower film web 5 in comparison with the use position.

What is claimed is:

1. A thermoforming packaging machine, comprising:

a film source for receiving a lower film supply roll and providing a lower film web unwound from the lower film supply roll;

a forming station for forming packaging troughs in the lower film web by thermoforming;

a sealing station for closing the packaging troughs by sealing an upper film to the lower film web; and a conveying device configured for conveying the lower film web from the film source to the forming station and further to the sealing station;

wherein the film source comprises a holding mandrel for receiving the lower film supply roll, and a film storage device configured to accommodate a variable length of the lower film web and to regulate a film tension of the lower film web, wherein the holding mandrel and the film storage device are arranged one above the other in a vertical direction, and wherein the film source further comprises a gluing table, which is movable between a use position and a stowed position, the gluing table providing, in the use position, a working surface oriented parallel to a path of the lower film web and being, in the stowed position, distanced from the path of the lower film web.

2. The thermoforming packaging machine according to claim 1, wherein the film source comprises a frame having attached thereto the holding mandrel and the film storage device.

3. The thermoforming packaging machine according to claim 1, wherein the film storage device comprises a dancer.

4. The thermoforming packaging machine according to claim 1, wherein the film storage device comprises deflection elements for deflecting the lower film web.

5. The thermoforming packaging machine according to claim 4, wherein the deflection elements comprise at least one stationary deflection element and at least one movable deflection element.

6. The thermoforming packaging machine according to claim 1, wherein the film source is configured so that the lower film web enters the film storage device on a first side of the holding mandrel and exits the film storage device on an opposite, second side of the holding mandrel when the lower film supply roll is received in the film source.

7. The thermoforming packaging machine according to claim 1, wherein the holding mandrel is configured to receive the lower film supply roll thereon in a non-rotatable manner.

8. The thermoforming packaging machine according to claim 1, wherein the film source has a drive unit for driving the holding mandrel, so as to unwind the lower film web.

9. The thermoforming packaging machine according to claim 8, wherein the drive unit is configured to drive the holding mandrel for continuously and uniformly unwinding the lower film web.

10. The thermoforming packaging machine according to claim 1, wherein the film storage device is arranged above the holding mandrel.

11. The thermoforming packaging machine according to claim 1, wherein the film storage device is arranged below the holding mandrel.

12. The thermoforming packaging machine according to claim 1, wherein the film source, the forming station and the sealing station are arranged linearly one after the other in a production line.

13. The thermoforming packaging machine according to claim 1, wherein the forming station and the sealing station are arranged linearly one after the other in a production line and the film source is arranged laterally offset relative to the production line.

14. The thermoforming packaging machine according to claim 1, wherein the gluing table is provided along the path of the lower film web between the holding mandrel and the film storage device.

15. The thermoforming packaging machine according to claim 1, wherein the gluing table is movable between the use position and the stowed position by rotation about an axis.

16. The thermoforming packaging machine according to claim 15, wherein the axis is a vertical axis.

17. A thermoforming packaging machine comprising:

a film source for receiving a lower film supply roll and providing a lower film web unwound from the lower film supply roll;

a forming station for forming packaging troughs in the lower film web by thermoforming;

a sealing station for closing the packaging troughs by sealing an upper film to the lower film web; and a conveying device configured to convey the lower film web from the film source to the forming station and further to the sealing station;

wherein the film source comprises a gluing table that is movable between a use position and a stowed position, the gluing table providing, in the use position, a working surface oriented parallel to a path of the lower film web and being, in the stowed position, distanced from the path of the lower film web.

18. The thermoforming packaging machine according to claim 17, wherein the film source comprises a holding mandrel configured to receive the lower film supply roll.

19. The thermoforming packaging machine according to claim 17, wherein the film source comprises a film storage device configured to accommodate a variable length of the lower film web and to regulate a film tension of the lower film web.

20. The thermoforming packaging machine according to claim 17, wherein the gluing table is movable between the use position and the stowed position by rotation about an axis.

* * * * *